US005240460A

United States Patent [19]

Tighe

[11] Patent Number: 5,240,460

[45] Date of Patent: Aug. 31, 1993

[54] INDOOR RECREATIONAL SYSTEM

[76] Inventor: James T. Tighe, 3429 Alta Vista, Waco, Tex. 76706

[21] Appl. No.: 885,177

[22] Filed: May 19, 1992

[51] Int. Cl.[5] ..... A63G 9/16

[52] U.S. Cl. ..... 472/118; 482/24; 248/200.1

[58] Field of Search ..... 472/116, 118; 52/204.71, 205, 210, 215; 248/200.1; 482/24, 35, 904

[56] References Cited

U.S. PATENT DOCUMENTS

| | | | |
|---|---|---|---|
| 324,513 | 8/1885 | Albrecht | 482/24 |
| 1,629,676 | 5/1927 | Buckminster | 482/24 |
| 2,839,299 | 6/1958 | Weiss | 472/116 |
| 3,342,484 | 9/1967 | Christensen | 482/24 |
| 3,593,708 | 7/1971 | Steele | 482/24 |
| 4,077,403 | 3/1978 | Steele | 482/24 |

*Primary Examiner*—Carl D. Friedman
*Assistant Examiner*—Beth A. Aubrey
*Attorney, Agent, or Firm*—Pravel, Hewitt, Kimbal & Krieger

[57] ABSTRACT

An indoor recreational system adapted for use with a door frame is disclosed. The indoor recreational system is provided in component parts and is foldable to reduce storage space when the system is not in use. The recreational system comprises two foldable upright members having a groove on one side adapted to be received about the inwardly facing rib of the door frame and two longitudinal members having slots at each end to be received about the frame rib to prevent lateral movement and a shoulder on each end of longitudinal member to engage and prevent inwardly movement of the upright members.

A number of interchangeable recreational devices can be used with the indoor recreational system including a swing seat, an exercise bar, a slide, two exercise rings or a child's safety seat.

A method of installation of the indoor recreational system is disclosed to achieve the greatest installed height for the upper longitudinal member.

20 Claims, 2 Drawing Sheets

FIG. 4
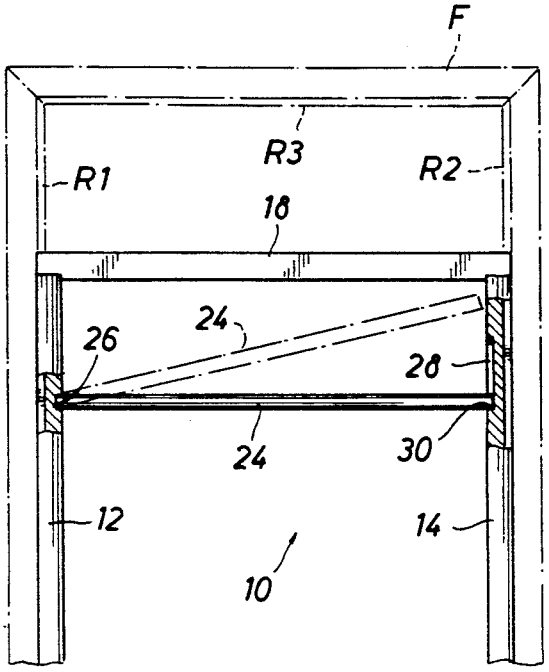
FIG. 5
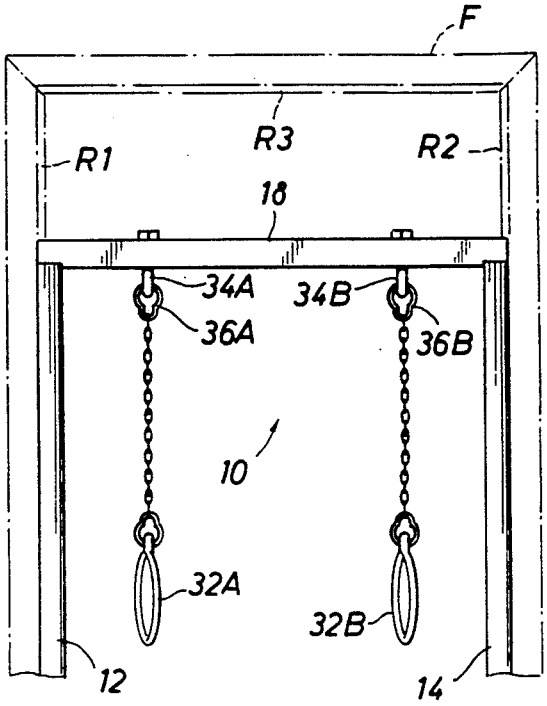
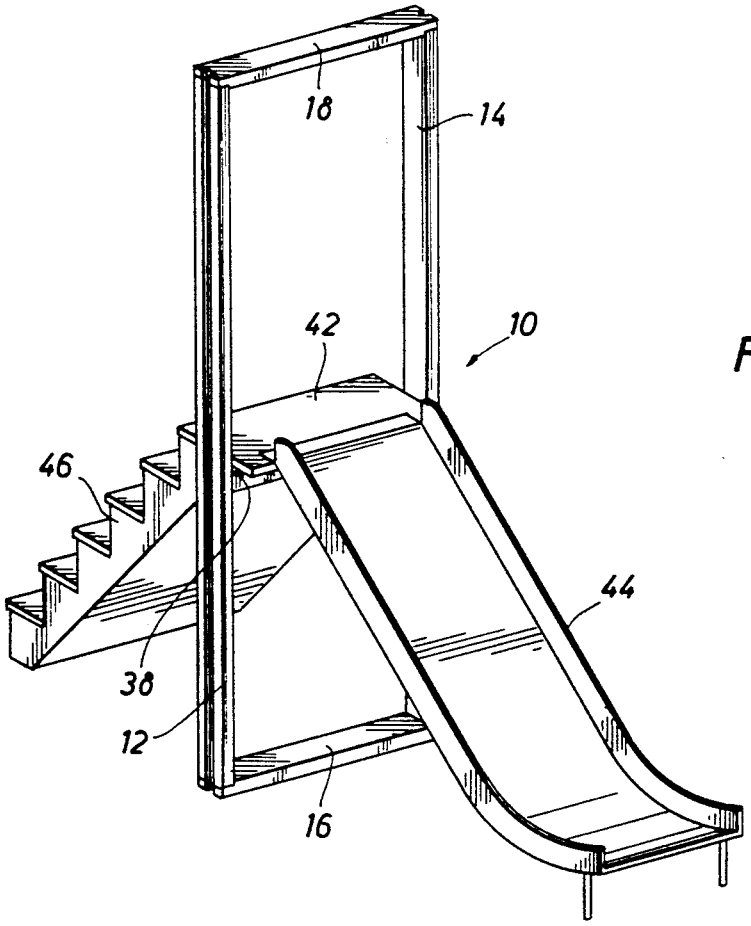
FIG. 6

INDOOR RECREATIONAL SYSTEM

BACKGROUND OF THE INVENTION

1. Field of the Invention

This invention relates generally to indoor recreational systems and more particularly to an indoor recreational system adapted for use with a door frame.

2. Description of the Prior Art

There are many devices in common use for providing indoor recreational activity. In fact, there are some indoor recreational devices that are adapted for use with the top of a door frame. Particularly, a known device comprises a seat suspended from a spring which is in turn suspended from a scissor type attachment that is receivable about the upwardly facing shoulders of the door frame.

A constant concern during the use of these indoor recreational devices is the safety of the user. For example, three safety concerns during the operation of the above indoor spring swing are inadvertent release of the recreational device from the door frame, failure of a component of the recreational device causing separation of the device, and injury to the user during operation of the recreational device caused by sharp edges and/or pinching. These safety concerns are enhanced when the child is jumping in the seat, such as the one described above. For example, the scissor attachment could slip off the upwardly facing shoulder of the door frame, the user fall to the floor with the spring and/or scissor attachment falling onto the user.

Additionally, a variety of different interchangeable recreational devices that could be attached with a sturdy frame structure would be desirable. This variety of indoor recreational devices should maintain the interest of the user for a longer period of time and permit the user to develop their different motor skills. Additionally, an indoor recreational system that provides these variety of indoor activities for use with one frame structure while being foldable and provided in components would be desirable to reduce storage space when the system is not in use.

SUMMARY OF THE PRESENT INVENTION

According to the invention, an indoor recreational system adapted for use with a door frame is provided. The indoor recreational system is provided in component parts and is foldable to decrease required storage space when the system is not in use. In summary, the recreational system comprises two upright members having a groove on one side adapted to be received about the inwardly facing rib or jam of the door frame. Also included are upper and lower longitudinal members having slots at each end to be received about the frame ribs to prevent lateral movement and a shoulder on each end of longitudinal member to engage and prevent inwardly movement of the upright members.

The indoor recreational system comprises interchangeable recreational devices such as a swing seat suspended by chains, an exercise bar connected directly to the upright members or suspended by chains, a slide supported by the upright members, exercise rings or a child's safety seat suspended by chains.

Advantageously, a method of installation indoor recreational system is provided to achieve the greatest installed height for the upper longitudinal member.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, of which:

FIG. 4 is a partial elevational view of the present invention showing the use of the exercise bar with the members.

FIG. 5 is a partial elevational view of the present invention showing the use of the exercise rings.

FIG. 6 is a perspective view of the frame structure, without showing the door frame for clarity, adapted for use with a slide.

DETAILED DESCRIPTION OF THE PREFERRED EMBODIMENT

Figure 1:
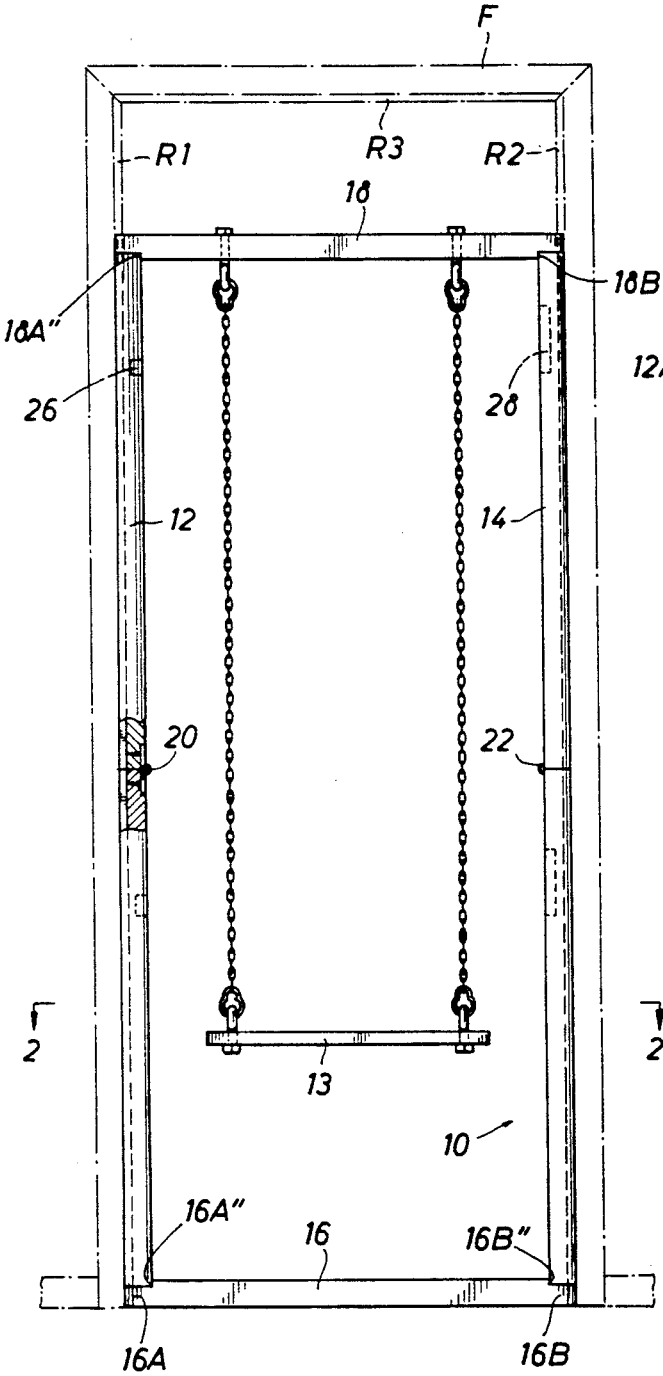
FIG. 1 is an elevational view of the present invention with a swing seat and the door frame shown in phantom view.

The Figures in the drawings show the different configurations of the recreational system, generally indicated at 10, to be used with the frame components of the present invention.

Figure 3:
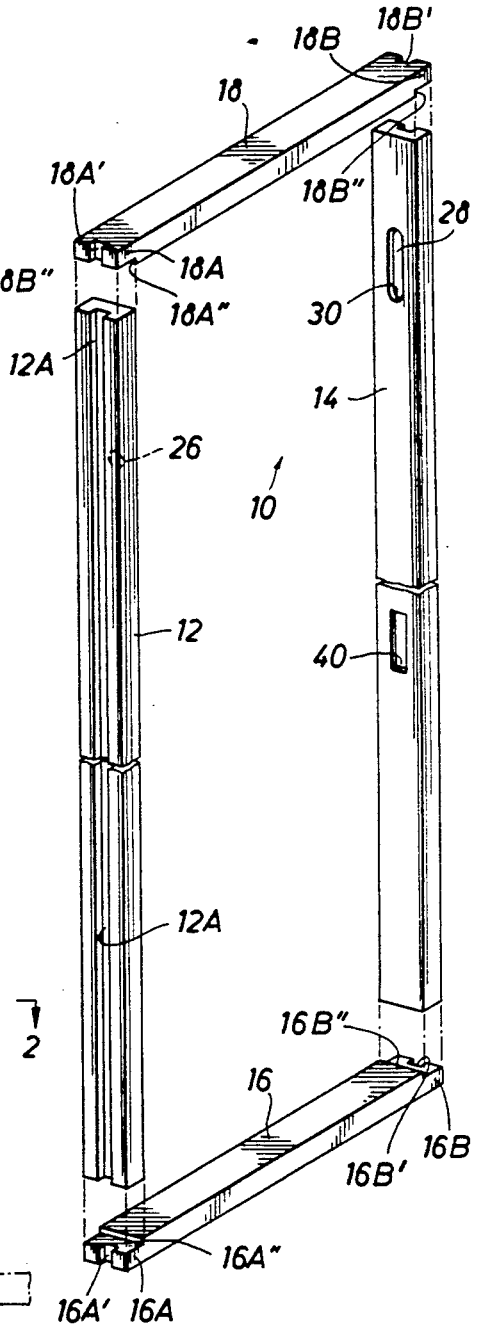
FIG. 3 is an exploded perspective view of the frame of the present invention.
Figure 2:
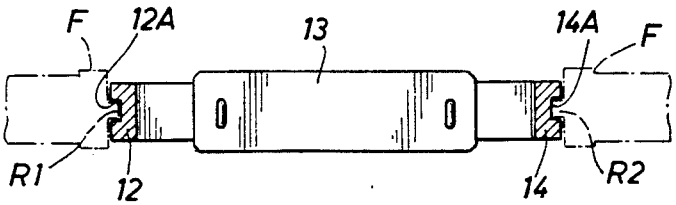
FIG. 2 is a section view taken along lines 2—2 of FIG. 1.

As shown in FIG. 1, the recreational system 10 is adapted for use with a door frame F. The conventional door frame F includes inwardly facing ribs or jams R1 and R2, as best shown in FIG. 2, on each vertical side of the door frame F and a downwardly facing rib R3. Each rib R1, R2, and R3 is similar in dimensions. In particular, the system frame components comprise a first upright member 12, a second upright member 14, a lower longitudinal member 16 and an upper longitudinal member 18. First upright member 12 has a groove 12A therein adapated to be received about the rib R1. Second upright member 14 similarly has a groove 14A therein, as best shown in FIGS. 1–3. The second member groove 14A is adapted to be received about frame rib R2.

A lower longitudinal member 16 having first and second ends 16A and 16B is best shown in FIGS. 1 and 3. Each end of longitudinal member 16 has a slot 16A', 16B' therein sized to be received about the frame ribs R1 and R2, respectively, to block lateral movement of member 16. The lower longitudinal member 16 also includes shoulders 16A'', 16B'' that engage the first and second upright members 12 and 14, respectively, as best shown in FIGS. 1 and 3 to block inward motion of the upright members. An upper longitudinal member 18 has first and second ends 18A, 18B, similar to longitudinal member 16. Each end of the second longitudinal member 18 has a slot 18A', 18B' therein sized to be received about the frame ribs R1 and R2, respectively, to block lateral movement of member 18. The longitudinal member 18, similar to member 16, also includes shoulders 18A'', 18B'' to engage the upright members 12 and 14, respectively, to block inward motion of the upright members.

In the preferred embodiment, the upright members 12 and 14 are each six foot (6') in length two-by-four wood members with a two and one-half inch (2½") hinge at their three-foot midpoint. Althouth the upright members are each preferably six feet in length, other lengths such as four feet or five feet could be used and are contemplated in the invention. As best shown in FIG. 1, the hinge 20 for member 12 and the hinge 22 for member 14 are positioned on the inwardly facing side of the members 12 and 14 so that when assembled with the longitudinal members 16 and 18, the hinges 20, 22 prevent inward buckling of the upright members 12, 14. The metal hinge is attached by a sufficient number and size of wood screws to their respective upright members to prevent inadvertent separation of the hinges from the members.

Each of the upright members 12, 14 will have continuous grooves 12A, 14A for the total length of the members. The grooves will preferably be centrally located on the widest side of the 2×4 members. Preferably, the grooves 12A, 14A should be one and three-eighth inches (1⅜") wide and three-eighth inches (⅜) deep. These dimensions were selected to allow the upright members to fit over conventional door ribs R1 or R2 on each side of the door frame F and to limit movement of the frame components when installed. However, if other standard size door frames and/or ribs are found, the members and/or grooves could be sized so that the upright member could be properly installed.

As a safety measure, all exposed wood members 12, 14, 16, 18 will preferably have their edges rounded, sanded and varnished. Additionally, a cushioning material, such as carpet, could be positioned on the inwardly facing surfaces of the members to reduce injuries to the user or scratching of objects moved through the door frame while the system was in use.

The longitudinal members 16 and 18 are each preferably 32 inches (32") in length and preferably would have a centrally located slot three-eighth inches (⅜") deep and one and three-eighth inches (1⅜") wide to be received about the ribs R1 and R2. The slots 16A', 16B', 18A' and 18B' are similar in size to the grooves 12A and 14A of the upright members. However, as explained above, other sizes could be used to achieve the objectives of this invention. Additionally, each end of the longitudinal members 16 and 18 will have a three-eighth inch (⅜") deep cut for a length of one and one-half inches (1 ½") to present shoulders 16A", 16B", 18A" and 18B".

Even though the preferred embodiment of the invention includes wood frame components, other materials could be used such as heavy plastic or aluminum.

Preferably, two eyebolts 4" in length will be positione eight inches from each end of the longitudinal member 18 or six and one-half inches (6½") from the shoulders 18A", 18B". These eyebolts will support any weight bearing device such as a swing seat, an exercise bar, a child's safety seat, or exercise rings, as described below in detail.

A conventional swing seat could be used or a seat that is 20 inches long made of one inch by six inch white pine could be fabricated. Additionally, the swing could be made of plastic, aluminum or leather. Eyebolts can be provided one and three-quarter inches from each side of the wood swing seat. Appropriate equal lengths of chain could be provided between the eyebolt of the upper longitudinal member and the eyebolts of the seat. Preferably, two pieces of plastic tubing or PVC pipe will be provided around the chain to prevent pinching. Four 5 mm snap links are preferably attached between the chain and the eyebolts to provide releasable engagement of the different recreational devices.

As can be seen in FIG. 4, an exercise bar 24 shown in phantom view, made of wood or metal, could be provided in a hole 26 in member 12 and then pivoted downwardly into groove 28 until the bar 24, shown in solid lines, rests on shoulder 30. Another interchangeable recreational device, shown in FIG. 5, are exercise rings 32A, 32B are hung from eyebolts 34A and 34B by snap rings 36A and 36B. Turning now to FIG. 6, a bar 38 could be positioned in a hole in upright 12 and pivoted downwardly into slot 40 in member 14, as best shown in FIG. 3, so as to hold a weight bearing means or platform 42 onto which a slide 44 could be connected on one side and steps or stairs 46 provided on the other side. These steps can be as shown in FIG. 6 or could be more of a conventional ladder configuration have ten inch long one-half inch dowels for steps. The platform 42 could be provided at a three foot height or four foot height. Alternatively, though not shown, each upright members could be sized to three foot or four foot in length and an upper longitudinal member positioned on top of the upright member to connect with a slide 44, and stairs or steps 46.

USE AND OPERATION

To install the recreational system, the lower longitudinal member 16 having a slot 16A', 16B' at each end is received about and engages door frame ribs R1 and R2 to prevent lateral movement of the lower longitudinal member. The first and second upright members 12, 14 are then unfolded and positioned so that their respective grooves 12A, 14A are received about the frame ribs, as best shown in FIG. 2, and engage the shoulders 16A", 16B" of the lower longitudinal member 16, as best shown in FIGS. 1 and 3. The upper longitudinal member 18 is then positioned on top of the upright members 12, 14 so that slots 18A', 18B' in each end of the upper longitudinal member engage the frame ribs R1 and R2 to block lateral movement. The shoulders 18A", 18B" of the upper member 18 are then positioned to block inwardly motion of the first and second upright members.

Alternatively, if additional installed height of member 18 is desired, members 16 and 18 could be installed about ribs R1 and R2 first and then while holding member 18 against upper rib R3, the upright members 12, 14, sized so that they extend the total vertical distance of the door frame minus the clearance required for member 18, are properly positioned about their respective ribs R1 and R2 and then member 18 is slid on top of the upright member 12, 14.

Finally, a weight bearing means is suspended or supported by the upright members for a variety of recreational activities. Examples of weight bearing means include, but are not limited to, those shown in the drawings of a swing seat 13, as shown in FIGS. 1 and 2, an exercise bar 24, as shown in FIG. 4, alternatively bar 24 could be suspended by chains from upper member 18; exercise rings, as shown in FIG. 5; a slide, as shown in FIG. 6; and a conventional child's safety seat (not shown) such as manufactured by The Little Tikes Co. of Hudson, Ohio. An alternative embodiment of the slide in FIG. 6 is contemplated as a weight bearing means as described above for recreational activities.

The foregoing disclosure and description of the invention are illustrative and explanatory thereof, and various changes in the size, shape and materials, as well as in the details of the illustrated construction may be made without departing from the spirit of the invention.

I claim:

1. Recreational system adapted for use with a door frame, said door frame having an inwardly facing rib on each vertical side of the frame, said system comprising a first upright member having a groove therein, said first member groove adapted to be received about one of the frame ribs, a second upright member having a groove therein; said second member groove adapted to be received about another one of the frame ribs, at least one longitudinal member having a first and second end; each end of said longitudinal member having a slot therein sized to be received about the frame ribs and a shoulder to engage said first and second upright members, and a weight bearing means supported by said first and second upright members for providing recreational activity.

2. System of claim 1 further comprising a second longitudinal member having a first and second end; each end of said second longitudinal member having a slot therein sized to be received about the frame ribs and a shoulder to engage said first and second upright members.

3. System of claim 1 wherein said first and second upright members are foldable.

4. System of claim 1 wherein said first and second upright members and said longitudinal members are fabricated from wood.

5. System of claim 1 wherein said first and second upright members and said longitudinal members are fabricated from aluminum.

6. System of claim 1 wherein said first and second upright members and said longitudinal members ;are fabricated from plastic.

7. System of claim 1 wherein said longitudinal member is positioned on top of said upright members and said weight bearing means is releasably attached to said longitudinal member.

8. System of claim 7 wherein said weight bearing means is a swing seat suspended from said longitudinal member.

9. System of claim 8 wherein said swing seat is suspended from a pair of chains from said longitudinal member.

10. System of claim 9 wherein tubes are disposed about said pair of chains.

11. System of claim 7 wherein said weight bearing means are a pair of rings suspended from said longitudinal member.

12. System of claim 7 wherein said weight bearing means is a slide supported by said first and second upright members.

13. System of claim 1 wherein said first and second upright member grooves are centrally disposed along the total length of one side of each of said upright members.

14. System of claim 1 wherein said first and second upright members are equal in length and each said upright member is less in length than the vertical side of the door frame.

15. System of claim 1 wherein said inwardly facing surface of said first and second upright members are cushioned.

16. System of claim 1 wherein said inwardly facing surface of said first and second upright members have rounded edges.

17. System of claim 1 wherein said weight bearing means is a bar positioned on said first and second upright members.

18. Recreational system adapted for use with a door frame, said door frame having an inwardly facing rib on each of the two vertical sides of the frame, said system comprising a first foldable member having a groove therein, said first member groove sized to be received about one of the frame ribs, a second foldable member having a groove therein; said second member groove sized to be received about another one of the frame ribs, an upper longitudinal member having a first and second end; each end having a slot therein sized to be received about the frame ribs and a shoulder to engage said first and second members, a lower longitudinal member having a first and second end; each end having a slot therein sized to be received about the frame ribs and a shoulder to engage said first and second members, a weight bearing means supported by said first and second members for providing a plurality of recreational activities while reducing storage space for the system.

19. Method of installation of a recreational system adapted for use with a door frame, said door frame having an inwardly facing rib on each of the two vertical sides of the frame and an upper rib on the top of the frame, the steps comprising a.) positioning a lower longitudinal member having a slot at each end so that each slot is received about and engages the door frame ribs to prevent lateral movement of said lower longitudinal member, said lower longitudinal member having a shoulder adjacent each of its ends, b.) positioning a first upright member having a groove therein so that said first member groove is received about one of the frame ribs and one of said shoulders of said lower longitudinal member blocks inwardly motion of said first member, c.) positioning a second upright member having a groove therein so that said second member groove is received about the other frame rib and the other shoulder of said lower longitudinal member blocks inwardly motion of said second member, d.) positioning an upper longitudinal member on top of said first and second upright members so that the slot in each end of the upper longitudinal member engages the frame ribs and is blocked from lateral movement and the shoulder adjacent each end of the upper longitudinal member prevents inwardly motion of the first and second upright members, and e.) supporting a first weight bearing means from the first and second upright members for recreational activities.

20. Method of claim 19 wherein said lower and upper longitudinal members are first received about the frame ribs and said upper longitudinal member is positioned against the upper rib, then said upright members are positioned to be received about their ribs, said upright members each having a length so that they extend the total vertical distance of the door frame minus the clearance required for the upper member, then said upper member is slid down on top of said upright members.

* * * * *